US009997284B2

(12) United States Patent
Miwa et al.

(10) Patent No.: US 9,997,284 B2
(45) Date of Patent: Jun. 12, 2018

(54) SINTERED MAGNET

(71) Applicant: TDK Corporation, Tokyo (JP)

(72) Inventors: Masashi Miwa, Tokyo (JP); Atsushi Fujiwara, Tokyo (JP); Eiji Kato, Tokyo (JP); Taeko Tsubokura, Tokyo (JP); Koji Mitake, Tokyo (JP); Chikara Ishizaka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 512 days.

(21) Appl. No.: 14/409,186

(22) PCT Filed: Jun. 21, 2013

(86) PCT No.: PCT/JP2013/067092
§ 371 (c)(1),
(2) Date: Dec. 18, 2014

(87) PCT Pub. No.: WO2013/191276
PCT Pub. Date: Dec. 27, 2013

(65) Prior Publication Data

US 2015/0170810 A1 Jun. 18, 2015

(30) Foreign Application Priority Data

Jun. 22, 2012 (JP) ..... 2012-140948

(51) Int. Cl.
*H01F 1/057* (2006.01)
*C22C 38/00* (2006.01)
(Continued)

(52) U.S. Cl.
CPC ..... *H01F 1/0577* (2013.01); *B22F 3/10* (2013.01); *C22C 38/001* (2013.01);
(Continued)

(58) Field of Classification Search
None
See application file for complete search history.

(56) References Cited

U.S. PATENT DOCUMENTS

2005/0268989 A1 12/2005 Tomizawa et al.
2007/0102069 A1* 5/2007 Hidaka ..... C22C 38/005 148/302

(Continued)

FOREIGN PATENT DOCUMENTS

CN 102067249 5/2011
JP 2002-038245 2/2002

(Continued)

OTHER PUBLICATIONS

English-language translation of International Preliminary Report on Patentability (IPRP) dated Dec. 31, 2014 that issued in WO Patent Application No. PCT/JP2013/067092.

*Primary Examiner* — Jessee R Roe
*Assistant Examiner* — Ngoclan T Mai
(74) *Attorney, Agent, or Firm* — Drinker Biddle & Reath LLP

(57) ABSTRACT

A sintered magnet of a preferred embodiment has a composition comprising: R (R is a rare earth element that must contain any one of Nd and Pr.): 29.5 to 33.0 mass %; B: 0.7 to 0.95 mass %; Al: 0.03 to 0.6 mass %; Cu: 0.01 to 1.5 mass %; Co: 3.0 mass % or less (provided that 0 mass % is not included.); Ga: 0.1 to 1.0 mass %; C: 0.05 to 0.3 mass %; O: 0.03 to 0.4 mass %; and Fe and other elements: a balance, and wherein a content of heavy rare earth elements in total is 1.0 mass % or less, and wherein the following relations are satisfied: $0.29<[B]/([Nd]+[Pr])<0.40$ and $0.07<([Ga]+[C])/[B]<0.60$, where [Nd], [Pr], [B], [C] and [Ga] represent the numbers of atoms of Nd, Pr, B, C and Ga, respectively.

4 Claims, 2 Drawing Sheets

(51) Int. Cl.

| | |
|---|---|
| ***C22C 38/06*** | (2006.01) |
| ***C22C 38/10*** | (2006.01) |
| ***C22C 38/14*** | (2006.01) |
| ***C22C 38/16*** | (2006.01) |
| ***B22F 3/10*** | (2006.01) |
| ***H01F 7/02*** | (2006.01) |

(52) U.S. Cl.
CPC ..... *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 7/02* (2013.01)

(56) References Cited

U.S. PATENT DOCUMENTS

| | | | | |
|---|---|---|---|---|
| 2007/0245851 | A1* | 10/2007 | Sagawa ..... | B22F 3/1021 75/10.67 |
| 2011/0095855 | A1 | 4/2011 | Kuniyoshi et al. | |
| 2013/0309122 | A1* | 11/2013 | Mochizuki ..... | C22C 38/002 419/33 |

FOREIGN PATENT DOCUMENTS

| | | | |
|---|---|---|---|
| JP | 2002-285276 | | 10/2002 |
| JP | 2009-260338 | A | 11/2009 |
| WO | WO-2004/081954 | A1 | 9/2004 |
| WO | WO-2009/150843 | A1 | 12/2009 |

* cited by examiner

SINTERED MAGNET

TECHNICAL FIELD

The present invention relates to a sintered magnet, specifically, an R-T-B based sintered magnet comprising at least a rare earth element (R), iron (Fe) and boron (B) as essential elements.

BACKGROUND ART

An R-T-B based sintered magnet has an excellent magnetic properties, thus the R-T-B based sintered magnet is used for various motors such as a voice coil motor (VCM) of a hard disk drive and a motor mounted on a hybrid car, home electric appliances and the like. When the R-T-B based sintered magnet is used for the motors and the like, the sintered magnet is required to have excellent heat resistance and high coercivity to cope with a high-temperature use environment.

As means for improving coercivity (HcJ) of the R-T-B based sintered magnet, in order to improve crystal magnetic anisotropy of a $R_2T_{14}B$ phase, a part of a rare earth element R, for which light rare earth elements such as Nd and Pr, are mainly used, is replaced by heavy rare earth elements, such as Dy and Tb. It has tended to be difficult to produce a magnet having coercivity usable for the motors and the like without using heavy rare earth elements.

However, Dy and Tb are scarce resources and expensive as compared to Nd and Pr. In recent years, concern for supply of Dy and Tb has become serious, because demand for high coercivity type R-T-B based sintered magnets which use large amounts of Dy and Tb has rapidly grown. Thus, even with a composition in which use of Dy and Tb is reduced as much as possible, it is required to obtain coercivity necessary for application to the motors and the like.

There have been many proposals for attempting improvement of magnetic properties by changing the composition of the R-T-B based sintered magnet. For example, Patent Literature 1 discloses an R-T-B based sintered magnet for which decrease of coercivity is suppressed in such a manner that an amount of B is reduced to less than a stoichiometric amount so as to suppress generation of a B-rich phase ($R_{1.1}Fe_4B_4$) and improve residual magnetic flux density (Br), while Ga is added to suppress generation of a soft magnetic $R_2Fe_{17}$ phase.

Moreover, Patent Literature 2 discloses a rare earth magnet in which variation in magnetic properties is suppressed while Br is improved by reducing an amount of B to less than a stoichiometric amount, and containing elements such as Zr, Ga and Si in combination.

CITATION LIST

Patent Literature

Patent Literature 1: International Publication No. WO 2004/081954A

Patent Literature 2: Japanese Patent Application Laid-Open No. 2009-260338A

SUMMARY OF INVENTION

Technical Problem

As described above, although a method for improving magnetic properties of the R-T-B based sintered magnet by adjusting its composition has been known, acquisition of coercivity applicable to the motors and the like still tended to be difficult with a composition in which a use amount of heavy rare earth elements such as Dy and Tb is reduced.

The present invention has been accomplished in light of such situation, and has an object to provide a sintered magnet capable of obtaining high coercivity, even though the use amount of heavy rare earth elements is reduced.

Solution to Problem

With the aim of achieving the object, a sintered magnet of the present invention has a composition comprising: R (R is at least one element selected from rare earth elements, and must contain any one of Nd and Pr.): 29.5 to 33.0 mass %; B: 0.7 to 0.95 mass %; Al: 0.03 to 0.6 mass %; Cu: 0.01 to 1.5 mass %; Co: 3.0 mass % or less (provided that 0 mass % is not included.); Ga: 0.1 to 1.0 mass %; C: 0.05 to 0.3 mass %; O: 0.03 to 0.4 mass %; and Fe and other elements: a balance, wherein a content of heavy rare earth elements in total is 1.0 mass % or less, and wherein the following relations are satisfied: $0.29<[B]/([Nd]+[Pr])<0.40$ and $0.07<([Ga]+[C])/[B]<0.60$, where [Nd], [Pr], [B], [C] and [Ga] represent the numbers of atoms of Nd, Pr, B, C and Ga, respectively.

According to the sintered magnet of the present invention, although the content of heavy rare earth elements in total is 1.0 mass % or less, the contents and atomic ratios of the other elements satisfy a specific relation, thereby obtaining high coercivity. Conventionally, it is general for an R-T-B based sintered magnet that when the content of B is low, the residual magnetic flux density is improved while the coercivity decreases, and in the above-described conventional art, various preparations have been performed to suppress the decrease of coercivity. On the other hand, according to the present invention, the content of B is reduced, while the contents of the other elements remain in the predetermined ranges, respectively, and further the atomic ratios of Nd and Pr, and Ga and C to B satisfy specific relations, respectively, thereby allowing improvement of coercivity rather than decreasing coercivity. As a result, it becomes possible to obtain high residual magnetic flux density and coercivity in a composition having a low content of the heavy rare earth elements.

Moreover, in the sintered magnet of the present invention, the content of Zr is preferably 1.5 mass % or less. The content of Zr satisfies such a condition, in addition to satisfying the above-described conditions for the respective elements, thereby allowing acquisition of higher coercivity, even with a composition having a low content of the heavy rare earth elements.

Then, since in the sintered magnet of the present invention, the respective elements are contained to satisfy the above-described specific conditions, the sintered magnet has a high residual magnetic flux density and high coercivity, and specifically, a value of coercivity×residual magnetic flux density is 1.8 (T·MA/m) or more. The sintered magnet having such properties is applicable to the motor and the like which are used in high temperature environments.

Advantageous Effects of Invention

According to the present invention, it is possible to provide a sintered magnet capable of obtaining high coercivity, even though the use amount of heavy rare earth elements is reduced.

DESCRIPTION OF EMBODIMENTS

Figure 1:
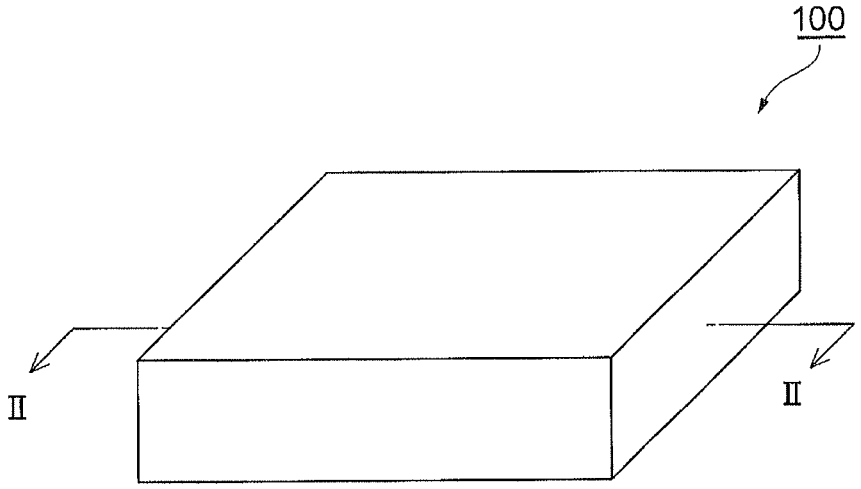
FIG. 1 is a perspective view of a sintered magnet according to a preferred embodiment.

Hereinafter, a preferred embodiment of the present invention will be specifically explained.

(Sintered Magnet)

A sintered magnet of the preferred embodiment is an R-T-B based rare earth permanent magnet having a composition comprising at least R (R is at least one element selected from rare earth elements, and must contain any one of Nd and Pr.), B, Al, Cu, Co, Ga, C, O and Fe. In the sintered magnet of the present embodiment, a content of each element with respect to total mass is as follows: R: 29.5 to 33 mass %; B: 0.7 to 0.95 mass %; Al: 0.03 to 0.6 mass %; Cu: 0.01 to 1.5 mass %; Co: 3.0 mass % or less (provided that 0 mass % is not included.); Ga: 0.1 to 1.0 mass %; C: 0.05 to 0.3 mass %; O: 0.03 to 0.4 mass %; and Fe and other elements: a balance. Note that, in the present specification, mass % is considered the same unit as weight %.

The sintered magnet of the present embodiment may contain a heavy rare earth element(s) as R. A content of the heavy rare earth element(s) is 1.0 mass % or less with respect to the total mass of the sintered magnet. Here, the heavy rare earth element means a rare earth element having a large atomic number, and rare earth elements from $_{64}$Gd to $_{71}$Lu generally correspond to it. Examples of the heavy rare earth element contained in the R-T-B based sintered magnet mainly include Dy, Tb and Ho. Therefore, the content of the heavy rare earth elements in the R-T-B based sintered magnet may be replaced with a total content of Dy, Tb and Ho.

Moreover, the sintered magnet of the present embodiment satisfies the following relations: $0.29<[B]/([Nd]+[Pr])<0.40$ and $0.07<([Ga]+[C])/[B]<0.60$, where [Nd], [Pr], [B], [C] and [Ga] represent the numbers of atoms of Nd, Pr, B, C and Ga, respectively. Here, the number of atoms of each element is a total number of atoms of each element contained in the sintered magnet. However, since [B]/([Nd]+[Pr]) and ([Ga]+[C])/[B] represent ratios of the numbers of atoms of the elements, respectively, for example, the ratios may be calculated in such a manner that a value of mass % of each element is calculated by the below-described fluorescent X-ray analysis and the like, and then divided by an atomic weight to obtain a value as the number of atoms, followed by substituting the value in each formula.

Hereinafter, the conditions for contents, atomic ratios and the like of the elements will be more specifically explained.

Firstly, in the present embodiment, R is at least one element selected from rare earth elements and must contain any one of Nd and Pr. Here, the rare earth elements are scandium (Sc), yttrium (Y), and lanthanoid elements, which belong to the Group III in the long-periodic table. Examples of the lanthanoid elements include lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu). R must contain any one of Nd and Pr and may contain both of them.

The content of R in the sintered magnet is 29.5 to 33 mass %. When the sintered magnet contains heavy rare earth elements as R, the total content of the rare earth elements including the heavy rare earth elements is in the above-described range. When the content of R is within this range, high Br and HcJ tend to be obtained. When the content of R is less than this range, it is difficult to form an $R_2T_{14}B$ phase, which is a main phase, but it is easy to form a soft magnetic α-Fe phase so that HcJ decreases. On the other hand, when the content of R is more than the above-described range, the volume proportion of the $R_2T_{14}B$ phase decreases so that Br decreases. The content of R may be 30.0 to 32.5 mass %. When the content of R is in this range, the volume proportion of the $R_2T_{14}B$ phase, which is the main phase, particularly increases, and further better Br is obtained.

R must contain any one of Nd and Pr. The percentage of Nd and Pr in total in R may be 80 to 100 atom %, or 95 to 100 atom %. Further better Br and HcJ can be obtained with this range.

As described above, the sintered magnet may contain heavy rare earth elements such as Dy, Tb and Ho as R, and in such case, the content of the heavy rare earth elements in the total mass of the sintered magnet is 1.0 mass % or less, preferably 0.5 mass % or less, and more preferably 0.1 mass % or less in total of the heavy rare earth elements. According to the sintered magnet of the present embodiment, even when the content of the heavy rare earth elements is reduced as described above, high HcJ can be obtained by satisfying specific conditions for the contents and the atomic ratios of elements other than the heavy rare earth elements.

In the sintered magnet, the content of B is 0.7 to 0.95 mass %. As described above, in the present embodiment, the content of B is in a specific range which is less than a stoichiometric proportion of a basic composition represented by $R_2T_{14}B$ of the R-T-B based sintered magnet, so that generation of a B rich phase is suppressed and Br can be improved. When the content of B is less than the above-described range, an $R_2T_{17}$ phase is easily deposited, and HcJ is likely to decrease. On the other hand, when the content of B is more than the above-described range, HcJ is also likely to decrease. The content of B may be 0.75 to 0.93 mass %. With this range, further better Br and HcJ can be obtained.

In the sintered magnet, the content of Al is 0.03 to 0.6 mass %, and may be 0.3 mass % or less. The content of Cu is 0.01 to 1.5 mass %, and may be 0.2 mass % or less. When the contents of these elements are within the above-described ranges, HcJ, corrosion resistance and temperature properties of the sintered magnet are improved.

In the sintered magnet, the content of Co is more than 0 mass % and 3.0 mass % or less. Co, similar to Fe, is an element represented by T in the basic composition of $R_2T_{14}B$, and forms a phase similar to Fe. The sintered magnet includes a phase containing Co so as to increase Curie temperature, and improve corrosion resistance of a grain boundary phase. Thus, the sintered magnet totally has high corrosion resistance. In order to obtain such effect more successfully, the content of Co may be 0.3 to 2.5 mass %.

The content of Ga is 0.1 to 1.0 mass %. When the content of Ga is less than this range, HcJ is insufficient, and when the content of Ga is more than this range, saturation magnetization decreases and Br is insufficient. In order to obtain HcJ and Br more successfully, the content of Ga may be 0.13 to 0.8 mass %.

The content of C is 0.05 to 0.3 mass %. When the content of C is less than this range, HcJ is insufficient, and when the content of C is more than this range, a ratio of a value of a magnetic field (Hk) when magnetization is 90% of Br to HcJ, so-called a squareness ratio (Hk/HcJ) becomes insufficient. In order to obtain HcJ and the squareness ratio more successfully, the content of C may be 0.1 to 0.25 mass %.

The content of O is 0.03 to 0.4 mass %. When the content of O is less than this range, the corrosion resistance of the sintered magnet is insufficient, and when the content of O is more than this range, a liquid phase is not sufficiently formed in the sintered magnet, and HcJ decreases. In order to obtain better corrosion resistance and HcJ, the content of O may be 0.05 to 0.3 mass %, and 0.05 to 0.25 mass %.

In the sintered magnet, it is preferable that the content of N is 0.15 mass % or less. When the content of N is more than this range, HcJ tends to be insufficient.

The sintered magnet of the present embodiment contains Fe and the other elements in addition to the above-described elements. Fe and the other elements occupy a balance other than the total content of the above-described elements in the total mass of the sintered magnet. However, in order that the sintered magnet sufficiently functions as a magnet, the total content of the elements other than Fe which occupy the balance is preferably 5 mass % or less with respect to the total mass of the sintered magnet.

The sintered magnet can contain, for example, Zr as the other elements. In that case, the content of Zr is preferably 1.5 mass % or less with respect to the total mass of the sintered magnet. Zr can suppress abnormal growth of crystal grains in the process of production of the sintered magnet, and makes the structure of the sintered body (sintered magnet) to be obtained uniform and fine, so as to improve magnetic properties. The content of Zr may be 0.03 to 0.25 mass %.

The sintered magnet may contain approximately 0.001 to 0.5 mass % of inevitable impurities, such as Mn, Ca, Ni, Si, Cl, S and F as constituent elements other than the above-described elements.

In the sintered magnet of the present embodiment, the contents of the respective elements are within the above-described ranges, and the numbers of atoms of Nd, Pr, B, C and Ga satisfy the following specific relations: that is, $0.29<[B]/([Nd]+[Pr])<0.40$ and $0.07<([Ga]+[C])/[B]<0.60$, where [Nd], [Pr], [B], [C] and [Ga] represent the number of atoms of Nd, Pr, B, C and Ga, respectively.

Since the following relations are satisfied: $0.29<[B]/([Nd]+[Pr])<0.40$ and $0.07<([Ga]+[C])/[B]<0.60$, high HcJ can be obtained. The factor is not necessarily clear, but the inventors of the present invention presume as the following explanation.

That is, as in the present embodiment, when the atomic ratio of B to Nd and Pr, which are mainly contained as R, is smaller than the atomic ratio of B to R in the basic composition represented by $R_2T_{14}B$, normally, a soft magnetic $R_2Fe_{17}$ phase is deposited in the grain boundary phase bearing coercivity, and the coercivity tends to severely decrease. It is known that a part of B in an $R_2T_{14}B$ compound can be substituted with C, but normally C is present as an impurity such as rare earth carbide in a grain boundary. Thus, the lack of B cannot be made up with C, and it is difficult to suppress deposition of the $R_2Fe_{17}$ phase.

On the other hand, as in the present embodiment, the sintered magnet contains both of C and Ga, where the atomic ratios of C and Ga with respect to B are more than and equal to a certain value, so that C can be contained in the $R_2T_{14}B$ compound to make up with at least a part of lack of B. Thus, the deposition of the $R_2Fe_{17}$ phase can be suppressed, and a compound in which a part of the $R_2T_{14}B$ compound is substituted with Ga or C is formed. As a result, anisotropy magnetic field is improved and coercivity is improved.

Under the conditions that the atomic ratios of C and Ga with respect to B are more than and equal to a certain value, the content of B is less than that in the basic composition of $R_2T_{14}B$, so as to easily form a specific phase containing R, Fe, Ga and C in the grain boundary. Since this phase is a phase having a low melting point, it is considered that the phase becomes a liquid phase by aging treatment and the like, and then penetrates a grain boundary, followed by weakening magnetically exchange coupling among grains of the $R_2T_{14}B$ compound, thereby improving coercivity. However, functions are not limited thereto.

The sintered magnet of the present embodiment contains the elements so that the above-described conditions for the specific contents and atomic ratios are satisfied. Then, by satisfying such conditions, although the contents of the heavy rare earth elements are low, the sintered magnet has high Br and high coercivity. Specifically, the value of coercivity×residual magnetic flux density is 1.8 (T·MA/m) or more, and in a more preferable case, the value can be 1.9 (T·MA/m) or more.

Figure 2:
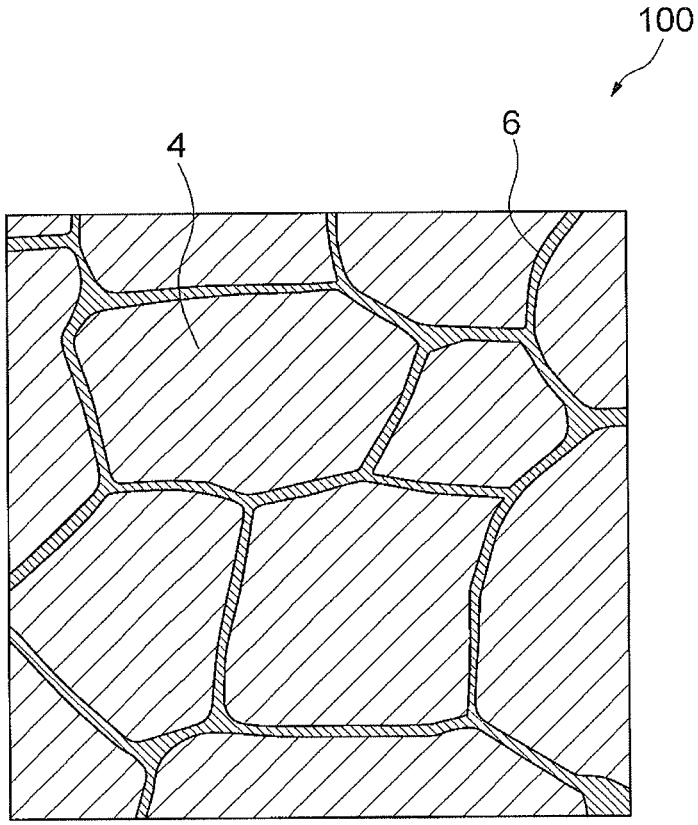
FIG. 2 is a schematic view showing an enlarged cross-sectional configuration of the sintered magnet shown in FIG. 1.

A preferred sintered magnet has, for example, a structure shown in FIGS. 1 and 2. FIG. 1 is a perspective view of the sintered magnet according to the preferred embodiment. FIG. 2 is a schematic view showing an enlarged cross-sectional configuration of the sintered magnet shown in FIG. 1.

As shown in FIGS. 1 and 2, in the preferred embodiment, a sintered magnet 100 contains a plurality of crystal grains 4 (main phase grains). A main phase of the sintered magnet 100 is constituted of the crystal grains 4. The crystal grains 4 contain R, Fe and B as main components, and are mainly formed of an $R_2Fe_{14}B$ compound. The rare earth magnet 100 contains a grain boundary phase 6 located among the plurality of crystal grains 4. The grain boundary phase 6 is a collective term of a phase containing more rare earth elements than the crystal grains 4, and formed of an R rich phase, an oxide phase and the like; however, these phases are shown indistinguishably in FIG. 2. Here, the oxide phase is a phase containing 20% or more of an oxygen element by element ratio in elements constituting the phase.

(Method for Producing Sintered Magnet)

Next, a preferred embodiment of a method for producing the above-described sintered magnet will be explained.

In the production of the sintered magnet, firstly, raw material metals of constituent elements of the sintered magnet are prepared, and then, raw material alloys are formed using these raw material metals by a strip casting method and the like. Examples of the raw material metals include rare earth metals, rare earth alloys, pure iron, ferroboron, and alloys thereof. Then, using these, a raw material alloy capable of providing a composition of a desired sintered magnet is formed. As the raw material alloy, a plurality of raw material alloys having different compositions may be prepared.

Next, the raw material alloy is pulverized to prepare raw material alloy powder. The pulverization of the raw material alloy is preferably performed in a coarse pulverization step and a fine pulverization step. The coarse pulverization step may be performed under an inert gas atmosphere by using, for example, a stamp mill, a jaw crusher, and a brown mill. Hydrogen absorption pulverization, namely, hydrogen is absorbed in the raw material alloy followed by pulverization, may be performed. In the coarse pulverization step, the raw material alloy is pulverized into powder until the powder has a particle diameter of about several hundreds micrometers.

Next, in the fine pulverization step, the coarsely pulverized powder obtained in the coarse pulverization step is finely pulverized to powder having an average particle diameter of 3 to 5 μm. The fine pulverization can be performed by using, for example, a jet mill. The raw material alloy is not necessarily pulverized in two steps of the coarse pulverization and fine pulverization, and the fine pulverization step may be performed from the beginning. Moreover, when a plurality of types of raw material alloys are prepared, these may be individually pulverized, and then mixed.

Thereafter, the thus obtained raw material powder is molded in the magnetic field (molding in the magnetic field) to obtain a green compact. More specifically, after the raw material powder is loaded in a press mold which is placed in an electromagnet, the raw material powder is pressed to mold while crystal axes of the raw material powder is aligned by application of the magnetic field by the electromagnet. The molding in the magnetic field may be performed, for example, in a magnetic field of 950 to 1600 kA/m under a pressure of approximately 30 to 300 MPa.

After the molding in the magnetic field, the green compact is sintered under vacuum or inert gas atmosphere to obtain a sintered body. It is preferred that the sintering is appropriately set depending on conditions of a composition, a pulverization method, particle size, and the like. For example, the sintering may be performed at 1000 to 1100° C. for 1 to 24 hours.

Then, as necessary, an aging treatment is applied to the sintered body, thereby obtaining a sintered magnet. The HcJ of a rare earth magnet obtained tends to be improved by performing the aging treatment. For example, the aging treatment can be applied in two stages. The aging temperature is preferably performed at two temperature conditions, about 800° C. and about 600° C. When the aging treatment is performed under these conditions, particularly excellent HcJ tends to be obtained. When the aging treatment is applied in one stage, the temperature is preferably about 600° C.

The sintered magnet of the preferred embodiment is obtained by the above-described production method. However, the method for producing the sintered magnet is not limited to the above-described method, and may be appropriately changed.

For example, a part of the constituent elements of the sintered magnet may be contained in the sintered body in the following manner: for example, a sintered body is obtained without containing the part of the constituent elements, and then the part of the constituent elements are attached to a surface of the sintered body, and diffused into the sintered body by thermal treatment.

Specifically, for example, a material containing heavy rare earth elements is attached to the surface of the sintered body of the present embodiment, and subjected to the thermal treatment so as to diffuse the heavy rare earth elements into the sintered body. Thus, although the content of the heavy rare earth elements increases, HcJ can be further improved.

However, when the heavy rare earth elements are diffused into the sintered body as in the above-described manner, with an excessive amount of the heavy rare earth elements to be contained in the sintered magnet by diffusion, the improvement of HcJ is saturated while Br tends to largely decrease depending on the content of the heavy rare earth elements. Therefore, as a result, eventually, the content of the heavy rare earth elements in the sintered magnet is preferably 1 mass % or less, and more preferably 0.5 mass % or less.

EXAMPLES

Hereinafter, the present invention will be further specifically described based on Examples. However, the present invention is not limited to these Examples.

[Preparation of Sintered Magnet] (Sample Nos. 1 to 25, Sample Nos. A1 to A8)

At first, raw material metals of a sintered magnet were prepared, and then raw material alloys were prepared using these raw material metals by a strip casting method so as to obtain compositions of Sample Nos. 1 to 25 and A1 to A8 Sintered Magnets shown in Tables 1 and 2. The contents of the elements shown in Tables 1 and 2 were measured as follows: Nd, Pr, Dy, Tb, Fe, Co, Ga, Al, Cu and Zr were measured by a fluorescent X-ray analysis; B was measured by an ICP emission analysis; O was measured by an inert gas fusion-non-dispersive Infrared absorption method; C was measured by an oxygen stream combustion-Infrared absorption method; and N was measured by an inert gas fusion-thermal conductivity method. Moreover, [B]/([Nd]+[Pr]) and ([Ga]+[C])/[B] were calculated by obtaining the number of atoms of each element from the contents of the elements which were obtained by the above-described methods.

Next, after hydrogen was absorbed into the obtained raw material alloys, a hydrogen pulverization treatment was performed under an argon gas atmosphere at 600° C. for 1 hour to conduct dehydrogenation. In these Examples, each step from the hydrogen pulverization to sintering (fine pulverization and molding) was performed under an atmosphere that an oxygen concentration is less than 100 ppm.

Next, to the hydrogen pulverized powder, oleic amide was added as a pulverizing agent, and mixed, and then the mixture was finely pulverized using a jet mill to obtain raw material powder having an average particle diameter of 4 μm. During the fine pulverization, the amount of the oleic amide to be added was adjusted so as to adjust the content of C in the composition of the final sintered magnet. Moreover, iron-oxide particles were mixed in the finely pulverized raw material powder so as to adjust the content of O in the composition of the final sintered magnet. Thereafter, the raw material powder was loaded in a press mold which was placed in an electromagnet, and molded in a magnetic field by application of the magnetic field of 1200 kA/m under a pressure of 120 MPa, thereby obtaining a green compact.

Thereafter, the green compact was sintered at 1060° C. under vacuum for 4 hours and quenched to obtain a sintered body. Then, to the obtained sintered body, an aging treatment was applied in two stages of 850° C. for 1 hour and 540° C. for 2 hours (both were under an argon gas atmosphere), thereby obtaining Sample Nos. 1 to 25 Sintered Magnet. Sample Nos. 1 to 17 and A1 to A6 Sintered Magnet satisfy the conditions of the present invention, and correspond to Working Examples, while Sample Nos. 18 to 25 and A7 to A8 Sintered Magnet do not satisfy the conditions of the present invention, and correspond to Comparative Examples.

[Evaluation of Properties]

Br (residual magnetic flux density) and HcJ (coercivity) of each of the sintered magnets of the obtained samples were measured by using a B-H tracer. The results are collectively shown in Tables 1 and 2.

TABLE 1

| Sample | Composition of Sintered Magnet (wt %) | | | | | | | | | | | | | | |
|---|---|---|---|---|---|---|---|---|---|---|---|---|---|---|---|
| | R | | | | | | | | | | | | | | |
| No. | Total | Nd | Pr | Dy | Tb | Fe | Co | Ga | Al | Cu | Zr | B | O | N | C |
| 1 | 32.0 | 24.0 | 8.0 | 0.00 | 0.00 | bal. | 0.51 | 0.40 | 0.20 | 0.09 | 0.20 | 0.95 | 0.06 | 0.05 | 0.13 |
| 2 | 32.0 | 24.0 | 8.0 | 0.02 | 0.00 | bal. | 0.50 | 0.40 | 0.21 | 0.10 | 0.20 | 0.92 | 0.08 | 0.05 | 0.13 |
| 3 | 32.0 | 24.0 | 8.0 | 0.01 | 0.00 | bal. | 0.51 | 0.40 | 0.20 | 0.10 | 0.19 | 0.87 | 0.05 | 0.06 | 0.13 |
| 4 | 32.0 | 24.0 | 8.0 | 0.03 | 0.00 | bal. | 0.51 | 0.40 | 0.21 | 0.09 | 0.20 | 0.83 | 0.06 | 0.05 | 0.14 |
| 5 | 32.0 | 24.0 | 8.0 | 0.01 | 0.00 | bal. | 0.50 | 0.40 | 0.20 | 0.10 | 0.20 | 0.78 | 0.07 | 0.05 | 0.13 |
| 6 | 32.0 | 24.0 | 8.0 | 0.00 | 0.00 | bal. | 0.51 | 0.40 | 0.20 | 0.10 | 0.20 | 0.71 | 0.05 | 0.05 | 0.15 |
| 7 | 32.0 | 24.0 | 8.0 | 0.02 | 0.00 | bal. | 0.51 | 0.13 | 0.20 | 0.10 | 0.20 | 0.92 | 0.08 | 0.05 | 0.06 |
| 8 | 32.0 | 24.0 | 8.0 | 0.01 | 0.00 | bal. | 0.51 | 0.15 | 0.20 | 0.09 | 0.20 | 0.92 | 0.15 | 0.05 | 0.10 |
| 9 | 32.0 | 24.0 | 8.0 | 0.03 | 0.00 | bal. | 0.51 | 0.60 | 0.20 | 0.10 | 0.19 | 0.92 | 0.06 | 0.06 | 0.15 |
| 10 | 32.0 | 24.0 | 8.0 | 0.00 | 0.00 | bal. | 0.51 | 0.70 | 0.20 | 0.09 | 0.20 | 0.92 | 0.07 | 0.05 | 0.19 |
| 11 | 32.0 | 24.0 | 8.0 | 0.01 | 0.00 | bal. | 0.51 | 0.80 | 0.21 | 0.10 | 0.20 | 0.83 | 0.15 | 0.05 | 0.20 |
| 12 | 32.0 | 24.0 | 8.0 | 0.02 | 0.00 | bal. | 0.51 | 0.70 | 0.20 | 0.10 | 0.20 | 0.78 | 0.14 | 0.04 | 0.22 |
| 13 | 31.0 | 23.3 | 7.8 | 0.00 | 0.00 | bal. | 0.51 | 0.10 | 0.20 | 0.10 | 0.00 | 0.92 | 0.19 | 0.05 | 0.07 |
| 14 | 32.0 | 24.0 | 8.0 | 0.03 | 0.00 | bal. | 0.51 | 0.10 | 0.20 | 0.09 | 0.00 | 0.94 | 0.24 | 0.05 | 0.10 |
| 15 | 32.9 | 24.7 | 8.2 | 0.01 | 0.00 | bal. | 0.51 | 0.95 | 0.21 | 0.10 | 0.20 | 0.73 | 0.21 | 0.06 | 0.30 |
| 16 | 32.1 | 24.0 | 8.0 | 0.04 | 0.00 | bal. | 0.51 | 0.80 | 0.20 | 0.10 | 0.20 | 0.83 | 0.15 | 0.05 | 0.24 |
| 17 | 32.0 | 24.0 | 8.0 | 0.02 | 0.00 | bal. | 0.51 | 0.70 | 0.20 | 0.10 | 0.20 | 0.73 | 0.15 | 0.05 | 0.25 |
| 18 | 31.0 | 31.0 | 0.0 | 0.00 | 0.00 | bal. | 1.00 | 0.04 | 0.20 | 0.10 | 0.00 | 0.94 | 0.40 | 0.05 | 0.05 |
| 19 | 2.93 | 29.3 | 0.0 | 0.00 | 0.00 | bal. | 0.88 | 0.04 | 0.12 | 0.10 | 0.09 | 0.91 | 0.21 | 0.05 | 0.06 |
| 20 | 32.0 | 24.0 | 8.0 | 0.01 | 0.00 | bal. | 0.51 | 0.15 | 0.20 | 0.10 | 0.20 | 0.68 | 0.05 | 0.05 | 0.10 |
| 21 | 32.0 | 24.0 | 8.0 | 0.02 | 0.00 | bal. | 0.51 | 1.50 | 0.20 | 0.10 | 0.20 | 0.83 | 0.15 | 0.05 | 0.30 |
| 22 | 31.5 | 23.6 | 7.9 | 0.02 | 0.00 | bal. | 0.50 | 0.10 | 0.21 | 0.10 | 0.20 | 1.00 | 0.10 | 0.05 | 0.16 |
| 23 | 31.0 | 23.3 | 7.8 | 0.00 | 0.00 | bal. | 0.52 | 0.12 | 0.20 | 0.10 | 0.20 | 0.94 | 0.07 | 0.05 | 0.25 |
| 24 | 32.5 | 24.4 | 8.1 | 0.01 | 0.00 | bal. | 0.49 | 0.25 | 0.20 | 0.10 | 0.20 | 0.70 | 0.10 | 0.05 | 0.25 |
| 25 | 31.0 | 23.2 | 7.7 | 0.00 | 0.00 | bal. | 0.53 | 0.10 | 0.20 | 0.10 | 0.20 | 0.88 | 0.05 | 0.05 | 0.05 |

| Sample | Ratio of numbers of atoms | | | Br | HcJ | Br × HcJ |
|---|---|---|---|---|---|---|
| No. | B/(Nd + Pr) | (C + Ga)/B | C/Ga | (mT) | (kA/m) | (T · MA/m) |
| 1 | 0.39 | 0.19 | 1.89 | 1410 | 1321 | 1.86 |
| 2 | 0.38 | 0.19 | 1.89 | 1393 | 1422 | 1.98 |
| 3 | 0.36 | 0.21 | 1.89 | 1386 | 1481 | 2.05 |
| 4 | 0.34 | 0.23 | 2.03 | 1385 | 1517 | 2.10 |
| 5 | 0.32 | 0.23 | 1.89 | 1374 | 1559 | 2.14 |
| 6 | 0.29 | 0.28 | 2.18 | 1367 | 1584 | 2.17 |
| 7 | 0.38 | 0.08 | 2.68 | 1398 | 1352 | 1.89 |
| 8 | 0.38 | 0.12 | 3.87 | 1405 | 1381 | 1.94 |
| 9 | 0.38 | 0.25 | 1.45 | 1388 | 1462 | 2.03 |
| 10 | 0.38 | 0.30 | 1.58 | 1379 | 1491 | 2.06 |
| 11 | 0.34 | 0.37 | 1.45 | 1376 | 1542 | 2.12 |
| 12 | 0.32 | 0.39 | 1.82 | 1375 | 1571 | 2.16 |
| 13 | 0.39 | 0.09 | 4.06 | 1417 | 1302 | 1.84 |
| 14 | 0.39 | 0.11 | 5.80 | 1412 | 1331 | 1.88 |
| 15 | 0.29 | 0.57 | 1.83 | 1353 | 1554 | 2.10 |
| 16 | 0.34 | 0.41 | 1.74 | 1359 | 1512 | 2.05 |
| 17 | 0.30 | 0.46 | 2.07 | 1366 | 1552 | 2.12 |
| 18 | 0.40 | 0.05 | 7.26 | 1371 | 1185 | 1.62 |
| 19 | 0.41 | 0.07 | 8.71 | 1430 | 982 | 1.40 |
| 20 | 0.28 | 0.17 | 3.87 | 1350 | 1078 | 1.46 |
| 21 | 0.34 | 0.61 | 1.16 | 1321 | 1215 | 1.61 |
| 22 | 0.42 | 0.16 | 9.29 | 1415 | 1204 | 1.70 |
| 23 | 0.40 | 0.26 | 12.1 | 1420 | 1195 | 1.70 |
| 24 | 0.29 | 0.38 | 5.80 | 1361 | 1160 | 1.58 |
| 25 | 0.38 | 0.07 | 2.90 | 1390 | 1206 | 1.68 |

TABLE 2

| Sample | Composition of Sintered Magnet (wt %) | | | | | | | | | | | | | | |
|---|---|---|---|---|---|---|---|---|---|---|---|---|---|---|---|
| No. | Total | Nd | Pr | Dy | Tb | Fe | Co | Ga | Al | Cu | Zr | B | O | N | C |
| A1 | 33.00 | 32.90 | 0.10 | 0.00 | 0.00 | bal. | 3.00 | 0.40 | 0.03 | 0.30 | 0.03 | 0.91 | 0.40 | 0.03 | 0.05 |
| A2 | 31.49 | 28.00 | 3.48 | 0.01 | 0.00 | bal. | 0.01 | 0.60 | 0.30 | 0.01 | 0.25 | 0.86 | 0.03 | 0.04 | 0.09 |
| A3 | 29.51 | 29.46 | 0.00 | 0.05 | 0.00 | bal. | 0.78 | 0.40 | 0.20 | 0.16 | 0.00 | 0.83 | 0.15 | 0.03 | 0.08 |
| A4 | 31.89 | 31.87 | 0.00 | 0.02 | 0.00 | bal. | 1.20 | 0.60 | 0.60 | 0.60 | 0.03 | 0.85 | 0.15 | 0.12 | 0.13 |
| A5 | 31.35 | 23.40 | 7.95 | 0.00 | 0.00 | bal. | 1.50 | 0.50 | 0.15 | 1.50 | 0.60 | 0.81 | 0.10 | 0.08 | 0.14 |
| A6 | 31.76 | 23.80 | 7.95 | 0.01 | 0.00 | bal. | 1.31 | 0.26 | 0.10 | 0.24 | 1.50 | 0.89 | 0.13 | 0.06 | 0.22 |

TABLE 2-continued

| | | | | | | | | | | | | | | | |
|---|---|---|---|---|---|---|---|---|---|---|---|---|---|---|---|
| A7 | 29.40 | 29.40 | 0.00 | 0.00 | 0.00 | bal. | 0.00 | 0.19 | 0.00 | 0.00 | 0.00 | 0.83 | 0.41 | 0.15 | 0.24 |
| A8 | 33.10 | 24.90 | 8.20 | 0.00 | 0.00 | bal. | 3.20 | 0.12 | 0.70 | 1.60 | 1.60 | 0.94 | 0.20 | 0.20 | 0.31 |

| Sample | Ratio of numbers of atoms | | | Br | HcJ | Br × HcJ |
|---|---|---|---|---|---|---|
| No. | B/(Nd + Pr) | (C + Ga)/B | C/Ga | (mT) | (kA/m) | (T · MA/m) |
| A1 | 0.37 | 0.12 | 0.726 | 1353 | 1370 | 1.85 |
| A2 | 0.36 | 0.20 | 0.871 | 1372 | 1532 | 2.10 |
| A3 | 0.38 | 0.16 | 1.161 | 1401 | 1353 | 1.90 |
| A4 | 0.36 | 0.25 | 1.258 | 1344 | 1580 | 2.12 |
| A5 | 0.34 | 0.25 | 1.625 | 1362 | 1621 | 2.21 |
| A6 | 0.37 | 0.27 | 4.912 | 1349 | 1507 | 2.03 |
| A7 | 0.38 | 0.30 | 7.332 | 1420 | 1052 | 1.49 |
| A8 | 0.38 | 0.32 | 14.995 | 1288 | 1131 | 1.46 |

As shown in Tables 1 and 2, it was confirmed that in Sample Nos. 1 to 17 and A1 to A6 Sintered Magnet which satisfied the conditions of the present invention, even though the content of the heavy rare earth elements, such as Dy and Tb was 0.1 mass % or less, Sample Nos. 1 to 17 and A1 to A6 Sintered Magnet had higher Br and HcJ than those of Sample Nos. 18 to 25 and A7 to A8 Sintered Magnet, which did not satisfy the conditions of the present invention.

[Evaluation of Diffusion of Heavy Rare Earth Element]

A sintered magnet having a composition of Sample No. 26 shown in Table 3 was prepared in the same manner as in Sample Nos. 1 to 25. The sintered magnet was processed into a shape of 13×8×2 mm, and then a slurry obtained by dispersing $DyH_2$ in an organic solvent was applied to a surface of the sintered magnet, followed by subjecting to a thermal treatment at 800° C. for 4 hours, and to an aging treatment at 540° C. for 1 hour, thereby preparing Sample Nos. 27 to 31 Sintered Magnet. In Sample Nos. 27 to 31 the amount of the slurry to be applied was changed so as to adjust the content of Dy.

Moreover, Sample Nos. 32 to 35 Sintered Magnets were prepared in the same manner as in the above description, except that $TbH_2$ was used instead of $DyH_2$.

Br and HcJ of the obtained sintered magnets were measured by using a B-H tracer. The compositions and evaluation results of the sintered magnets are collectively shown in Table 3.

TABLE 3

| Sample | Composition of Sintered Magnet (wt %) | | | | | | | | | | | | | | |
|---|---|---|---|---|---|---|---|---|---|---|---|---|---|---|---|
| | R | | | | | | | | | | | | | | |
| No. | Total | Nd | Pr | Dy | Tb | Fe | Co | Ga | Al | Cu | Zr | B | O | N | C |
| 26 | 32.0 | 24.0 | 8.0 | 0.00 | 0.00 | bal. | 0.51 | 0.20 | 0.20 | 0.09 | 0.20 | 0.91 | 0.08 | 0.05 | 0.10 |
| 27 | 32.0 | 24.0 | 8.0 | 0.10 | 0.00 | bal. | 0.50 | 0.20 | 0.20 | 0.09 | 0.20 | 0.91 | 0.08 | 0.05 | 0.10 |
| 28 | 32.1 | 23.9 | 8.0 | 0.27 | 0.00 | bal. | 0.51 | 0.20 | 0.20 | 0.09 | 0.20 | 0.91 | 0.09 | 0.05 | 0.10 |
| 29 | 32.1 | 23.7 | 7.9 | 0.49 | 0.00 | bal. | 0.50 | 0.20 | 0.20 | 0.09 | 0.20 | 0.91 | 0.09 | 0.05 | 0.10 |
| 30 | 32.2 | 23.6 | 7.9 | 0.72 | 0.00 | bal. | 0.51 | 0.20 | 0.20 | 0.09 | 0.20 | 0.91 | 0.09 | 0.05 | 0.10 |
| 31 | 32.2 | 23.4 | 7.8 | 0.98 | 0.00 | bal. | 0.51 | 0.20 | 0.20 | 0.09 | 0.20 | 0.91 | 0.09 | 0.05 | 0.10 |
| 32 | 32.0 | 23.9 | 8.0 | 0.00 | 0.15 | bal. | 0.50 | 0.20 | 0.20 | 0.09 | 0.20 | 0.91 | 0.09 | 0.05 | 0.10 |
| 33 | 32.1 | 23.9 | 8.0 | 0.00 | 0.25 | bal. | 0.51 | 0.20 | 0.20 | 0.09 | 0.20 | 0.91 | 0.09 | 0.05 | 0.10 |
| 34 | 32.1 | 23.8 | 7.9 | 0.00 | 0.45 | bal. | 0.51 | 0.20 | 0.20 | 0.09 | 0.20 | 0.91 | 0.09 | 0.05 | 0.10 |
| 35 | 32.2 | 23.5 | 7.9 | 0.00 | 0.76 | bal. | 0.51 | 0.20 | 0.20 | 0.09 | 0.20 | 0.91 | 0.09 | 0.05 | 0.10 |

| Sample | Ratio of numbers of atoms | | | Br | HcJ | Br × HcJ |
|---|---|---|---|---|---|---|
| No. | B/(Nd + Pr) | (C + Ga)/B | C/Ga | (mT) | (kA/m) | (T · MA/m) |
| 26 | 0.38 | 0.13 | 2.90 | 1392 | 1396 | 1.94 |
| 27 | 0.38 | 0.13 | 2.90 | 1382 | 1615 | 2.23 |
| 28 | 0.38 | 0.13 | 2.90 | 1373 | 1754 | 2.41 |
| 29 | 0.38 | 0.13 | 2.90 | 1369 | 1845 | 2.53 |
| 30 | 0.38 | 0.13 | 2.90 | 1361 | 1901 | 2.59 |
| 31 | 0.39 | 0.13 | 2.90 | 1349 | 1930 | 2.60 |
| 32 | 0.38 | 0.13 | 2.90 | 1384 | 1906 | 2.64 |
| 33 | 0.38 | 0.13 | 2.90 | 1374 | 2000 | 2.75 |
| 34 | 0.38 | 0.13 | 2.90 | 1368 | 2115 | 2.89 |
| 35 | 0.38 | 0.13 | 2.90 | 1358 | 2178 | 2.96 |

As shown in Table 3, it was confirmed that, into Sample No. 26 Sintered Magnet which satisfied the conditions of the present invention, heavy rare earth elements were diffused within a range that satisfied the conditions of the content of the heavy rare earth elements of the present invention, thereby further improving HcJ.

REFERENCE SIGNS LIST

4: crystal grain, 6: grain boundary phase, 100: sintered magnet.

The invention claimed is:

1. A sintered magnet having a composition comprising:

at least one element selected from rare earth elements, R, that contains any one of Nd and Pr: 29.5 to 33.0 mass %;

B: 0.7 to 0.95 mass %;

Al: 0.03 to 0.6 mass %;

Cu: 0.01 to 1.5 mass %;

Co: greater than 0 mass % to up to and including 3.0 mass %;

Ga: 0.1 to 1.0 mass %;

C: 0.05 to 0.3 mass %;

O: 0.03 to 0.4 mass %; and

Fe and other elements: a balance, wherein a content of heavy rare earth elements in total is 1.0 mass % or less, and wherein the following relations are satisfied: $0.29<[B]/([Nd]+[Pr])<0.40$ and $0.07<([Ga]+[C])/[B]<0.60$, where [Nd], [Pr], [B], [C] and [Ga] represent the numbers of atoms of Nd, Pr, B, C and Ga, respectively.

2. The sintered magnet according to claim 1, wherein a content of Zr is 1.5 mass % or less.

3. The sintered magnet according to claim 1, wherein a value of coercivity×residual magnetic flux density is 1.8 (T·MA/m) or more.

4. The sintered magnet according to claim 1, wherein $[B]/([Nd]+[Pr])<0.39$.

* * * * *